US007334966B2

(12) United States Patent
Marshall et al.

(10) Patent No.: US 7,334,966 B2
(45) Date of Patent: Feb. 26, 2008

(54) REINFORCEMENT OF TUBULAR STRUCTURES

(75) Inventors: Peter Marshall, Houston, TX (US); Stephen J. Kennedy, Ottawa (CA)

(73) Assignee: Intelligent Engineering (Bahamas) Limited, Nassau (BS)

( * ) Notice: Subject to any disclaimer, the term of this patent is extended or adjusted under 35 U.S.C. 154(b) by 0 days.

(21) Appl. No.: 10/533,386

(22) PCT Filed: Oct. 28, 2003

(86) PCT No.: PCT/GB03/04628

§ 371 (c)(1),
(2), (4) Date: Nov. 21, 2005

(87) PCT Pub. No.: WO2004/038106

PCT Pub. Date: May 6, 2004

(65) Prior Publication Data

US 2006/0153641 A1 Jul. 13, 2006

Related U.S. Application Data

(60) Provisional application No. 60/421,739, filed on Oct. 28, 2002.

(51) Int. Cl.
*E02B 17/00* (2006.01)

(52) U.S. Cl. ..... 405/211; 405/216

(58) Field of Classification Search ..... 405/211, 405/211.1, 216

See application file for complete search history.

(56) References Cited

U.S. PATENT DOCUMENTS

| | | | | | |
|---|---|---|---|---|---|
| 3,597,930 | A * | 8/1971 | Rochelle et al. | ..... | 405/211 |
| 4,019,301 | A * | 4/1977 | Fox | ..... | 405/216 |
| 4,023,374 | A * | 5/1977 | Colbert et al. | ..... | 405/216 |
| 4,439,071 | A * | 3/1984 | Roper, Jr. | ..... | 405/216 |
| 4,692,064 | A | 9/1987 | Wankmuller | | |
| 4,743,142 | A * | 5/1988 | Shiraishi et al. | ..... | 405/216 |
| 5,380,131 | A * | 1/1995 | Crawford | ..... | 405/216 |
| 5,778,813 | A | 7/1998 | Kennedy | | |
| 5,829,920 | A * | 11/1998 | Christenson | ..... | 405/216 |
| 5,919,004 | A * | 7/1999 | Christenson | ..... | 405/216 |
| 6,050,208 | A | 4/2000 | Kennedy | | |
| 6,364,575 | B1 * | 4/2002 | Bradley et al. | ..... | 405/216 |

FOREIGN PATENT DOCUMENTS

| | | |
|---|---|---|
| WO | WO-01/32414 A3 | 5/2001 |
| WO | WO-02/20341 A2 | 3/2002 |
| WO | WO-02/078948 A1 | 10/2002 |

* cited by examiner

*Primary Examiner*—Frederick L. Lagman
(74) *Attorney, Agent, or Firm*—Darby & Darby

(57) ABSTRACT

A tubular structure is reinforced or reinstated by providing a reinforcing layer in its interior in spaced relation to the existing structure so that a cavity is formed. Plastics or polymer material, preferably a compact elastomer, is injected into the cavity and cures to bond the existing structure and reinforcing layer together so that shear forces are transferred and the reinforced structure behaves as a composite body.

19 Claims, 2 Drawing Sheets

REINFORCEMENT OF TUBULAR STRUCTURES

RELATED APPLICATION

The present application is a National Phase filing of International Application No. PCT/GB 2003/004628, filed on Oct. 28, 2003 with priority claimed from U.S. Provisional Patent Application No. 60/421,739 filed Oct. 28, 2002.

FIELD OF THE INVENTION

The present invention relates to methods of reinforcing or reinstating tubular structures, especially off-shore structures.

BACKGROUND OF THE INVENTION

Structural sandwich plate members are described in U.S. Pat. No. 5,778,813 and U.S. Pat. No. 6,050,208, which documents are hereby incorporated by reference, and comprise outer metal, e.g. steel, plates bonded together with an intermediate elastomer core, e.g. of unfoamed polyurethane. These sandwich plate systems, commercialised under the trade mark SPS, may be used in many forms of construction to replace stiffened steel plates and greatly simplify the resultant structures, improving strength and structural performance (e.g. stiffness, damping characteristics) while saving weight. Further developments of these structural sandwich plate members are described in WO 01/32414, also incorporated hereby by reference. As described therein, foam forms may be incorporated in the core layer to reduce weight and transverse metal sheer plates may be added to improve stiffness.

According to the teachings of WO 01/32414 the foam forms can be either hollow or solid. Hollow forms generate a greater weight reduction and are therefore advantageous. The forms described in that document are not confined to being made of light weight foam material and can also be made of other materials such as wood or steel boxes.

International Patent Application WO 02/078948 is a further development of the concept of including hollow forms and describes forms that are easy to manufacture and assemble, in particular hollow elongate forms made from snap-together pieces are described.

International Patent Application WO 02/20341 describes a method whereby existing structures may be reinforced or reinstated by welding a plate in spaced relation to a panel of the existing structure and injecting uncured plastics or polymer material into the resulting cavity such that, when the injected material cures, it bonds to the existing panel and new plate with sufficient strength to transfer shear forces between them. The resulting structure behaves as a single body. This method is particularly advantageous in that it can usually be performed more quickly than the conventional technique of cutting out the damaged or corroded plates in the existing structure and welding a new plate in place. Also described is a method of reinforcing a pipeline by welding a jacket around the pipeline and filling the space between the pipeline and jacket with plastics or polymer material.

Some off-shore structures are supported by hollow tubular steel columns resting, or driven into, the sea floor. These columns are particularly susceptible to corrosion and are difficult to repair or replace. The techniques described in WO 02/20341 are particularly difficult to apply because of the difficulties of welding and injecting the core material underwater, especially at depth. It would also be difficult to maintain the inner surfaces of the cavity sufficiently clean and dry for the cured core to bond to the metal layers with sufficient strength. However, the advantages of an SPS(™) structure would be particularly beneficial in these types of structures.

SUMMARY OF THE INVENTION

It is an aim of the present invention to provide a method of structurally reinforcing or reinstating a tubular structure and in particular that can be implemented on submerged structures or submerged parts of structures.

According to the present invention, there is provided a method of reinforcing or reinstating an existing structure comprising the steps of:

attaching a reinforcing metal layer to said metal panel in spaced apart relation to thereby form at least one cavity between surfaces of said metal panel and said reinforcing metal layer;

injecting an intermediate layer comprised of an uncured plastics or polymer material into said at least one cavity; and curing said plastics or polymer material so that it adheres to said surfaces of said metal panel and said reinforcing metal layer so as to transfer shear forces therebetween; wherein said existing metal structure comprises a generally tubular part and said reinforcing metal layer is attached inside tubular part.

By installing the reinforcing metal layer inside a tubular part of the existing structure, the method of the invention can be performed in a protected environment enabling the metal surfaces to be cleaned and prepared for bonding to the core material and maintained in that state until the core material is injected.

Where the tubular part is a submerged part of an off-shore structure such as a support leg or bracing member, the inside of the leg can be pumped dry allowing the attachment of the reinforcing plate, e.g. by welding, and the injection of the core material to be performed much more readily than would be possible underwater. Even in a non-submerged part of an off-shore structure, working in a sheltered environment has distinct advantages, e.g. by simplifying the process.

To enable the reinforcing layer to be brought into the interior of the part being reinforced, it may be constructed as a series of plates or shaped parts that are welded together in situ. The reinforcing layer preferably comprises complete rings though may also be limited in extent to the area that is damaged or corroded. The reinforcing layer may also cover end walls of the tubular part as well as side walls.

The materials, dimensions and general properties of the reinforcing layer of the invention may be chosen as desired for the particular use to which the structure is put and in general may be similar the outer metal plates described in U.S. Pat. No. 5,778,813 and U.S. Pat. No. 6,050,208. Steel or stainless steel is commonly used in thicknesses of 0.5 to 20 mm and aluminium may be used where light weight is desirable. Similarly, the plastics or polymer core may be any suitable material, for example an elastomer such as polyurethane, as described in U.S. Pat. No. 5,778,813 and U.S. Pat. No. 6,050,208.

BRIEF DESCRIPTION OF THE DRAWINGS

The present invention will be described below with reference to exemplary embodiments and the accompanying schematic drawings, in which.

In the various drawings, like parts are indicated by like reference numerals.

DETAILED DESCRIPTION

Figure 1:
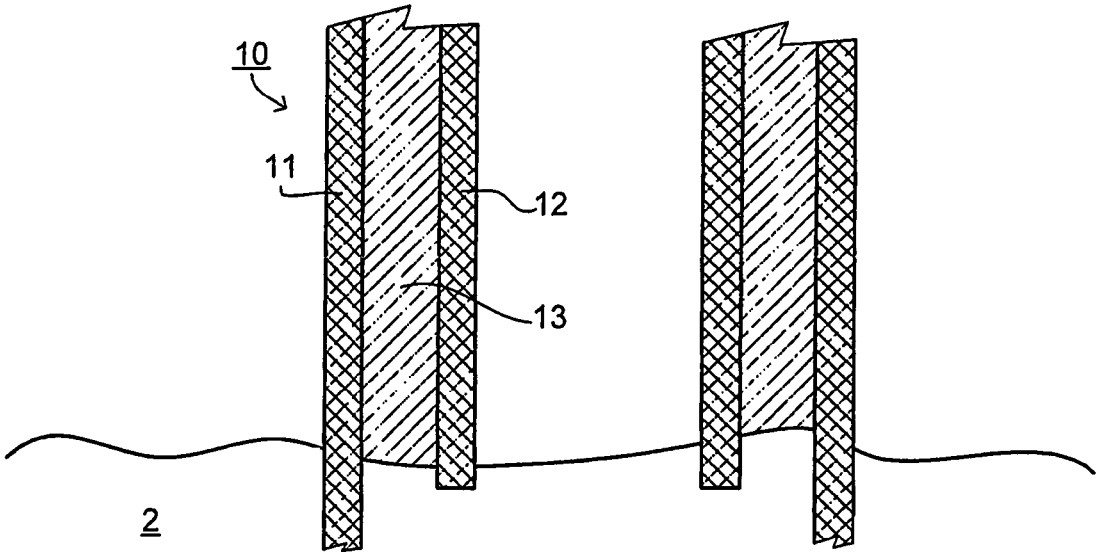
FIG. 1 is a vertical cross-section of a submerged support leg of an-offshore structure that has been reinforced according to the method of the present invention.
Figure 2:
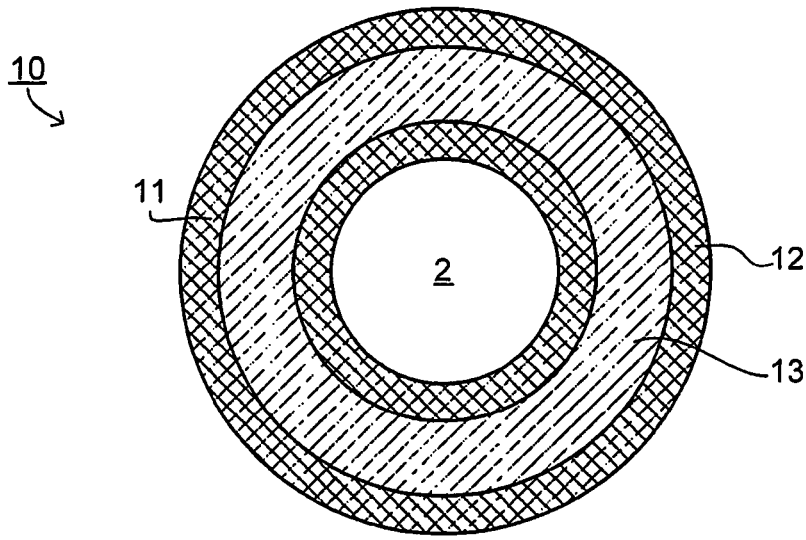
FIG. 2 is a horizontal cross-sectional view of the submerged support leg of FIG. 1.

FIGS. 1 and 2 show a piling 10 of an off-shore structure, as an example of a generally tubular structure, embedded in the sea bed 2. FIG. 1 is a vertical cross-section, FIG. 2 a plan view. The piling comprises an original, outer cylindrical member which may be made of steel or another metal and have a thickness of e.g. in the range of from 3 to 50 mm. An inner cylindrical member 12 is provided to reinforce the existing structure and is sized and positioned to form a cavity between the opposed surfaces of the inner and outer member.

The inner cylindrical member may be made of steel or another metal and have a thickness of e.g. in the range of from 3 to 50 mm. Depending on the access to the interior of the original member 11, the inner reinforcing member 12 may be a single piece or made form smaller plates or parts, such as rings, that are welded together in place. The inner member 12 may be driven into the sea bed or simply rest upon it.

In the cavity between the inner and outer members 11, 12 is a core 13 of plastics or polymer material, preferably a thermosetting material such as polyurethane elastomer. This core may have a thickness in the range of from 15 to 200 mm. Thicknesses greater than 100 mm may be achieved by casting multiple layers. The core 13 is bonded to the inner and outer members 11, 12 with sufficient strength and has sufficient mechanical properties to transfer shear forces expected in use between the two face plates. The bond strength between the core 13 and inner and outer members 11, 12 should be greater than 0.1 Mpa, preferably 6 MPa, and the modulus of elasticity of the core material should be greater than 250 MPa. By virtue of the core layer, the reinforced piling has a strength and load bearing capacity of a stiffened steel structure having a substantially greater plate thickness and significant additional stiffening.

Filling the cavity between the outer and inner members 11,12 may be in some cases be done simply by pouring the liquid core material into the open top of the cavity. Alternatively, the core material may be injected via injection ports provided in the inner member and ground off after use. Vent holes are likewise filled and ground smooth after the core has cured.

Shear plates and/or bulkheads connecting the inner and outer members 11,12, and/or extending across the centre of the tubular part may also be provided, as desired. If the inner member is installed in stages, a bulkhead may provide a useful platform for working on to install the next stage. The core may also include lightweight forms, as disclosed in WO 01/32414, to reduce the weight of the structure. These are placed within the cavity before injection of the core material.

To install the inner member, the interior of the piling may be pumped out, and depending on the depth pressurised, so that the inner surface of the outer member can be prepared and the inner member can be installed in dry conditions. In this way, it is possible to avoid disturbing the pile-to-soil adhesion.

It should be appreciated that the method of the invention may be applied to a structure that has been in situ for an extended period so as to reinstate it to original strength after corrosion or other damage or to upgrade it to carry additional loads. It may also be applied to the construction of new pilings.

Figure 3:
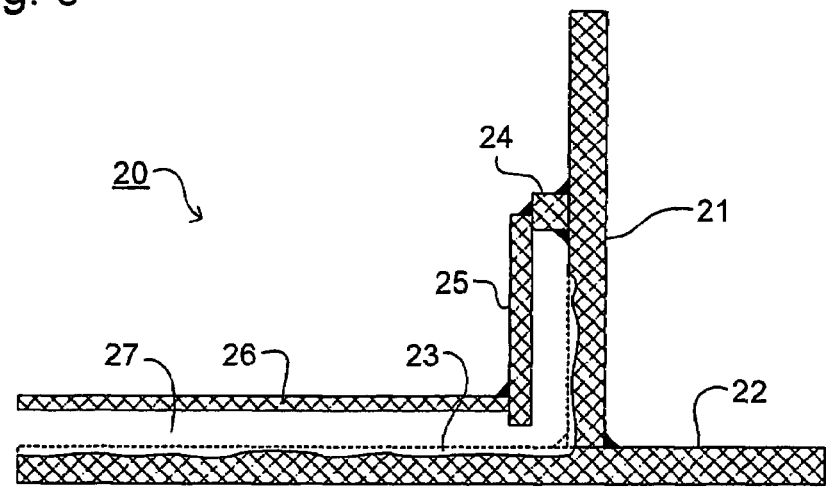
FIG. 3 is a cross-section of a part of a support leg in a semi-submersible off-shore structure that has been reinforced according to the method of the present invention.

A second embodiment of the present invention is shown in FIG. 3. In this case the invention is applied to repair corrosion dam age in the support leg 21 of a semi-submersible structure 20, where it joins the pontoon deck 22. Water may collect in this area, leading to corrosion 23. After cleaning and treatment of the damaged area in accordance with proper surface preparation methods, e.g. by grit blasting, a series of bars 24 is welded around the inside of the leg 21 above the corrosion damaged area 23 to support plates 25 which form an inner reinforcing layer around the damaged area. A bottom plate 26 is welded to the plates 25 so that a cavity is formed between the reinforcing plates 25, 26 forming the inner layer, and the pontoon deck 22 and leg 21 forming the outer layer. This cavity is filed with plastics or polymer material as in the first embodiment to form a structural sandwich plate arrangement with strength equal to or greater than the original.

Figure 4:
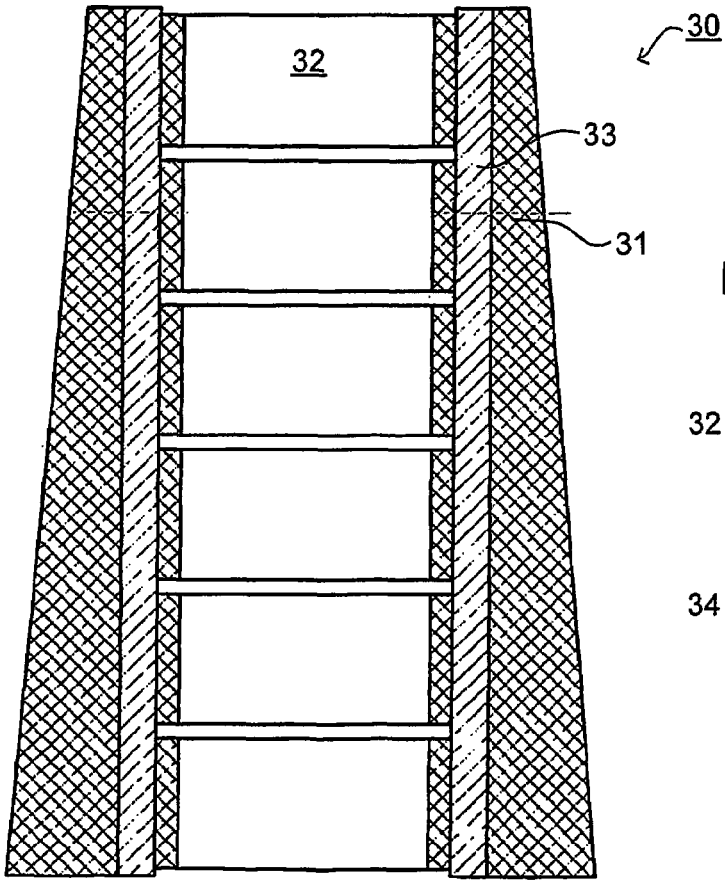
FIG. 4 is a cross-sectional view of a tapered stress joint in a riser according to an fourth embodiment of the present invention.
Figure 5:
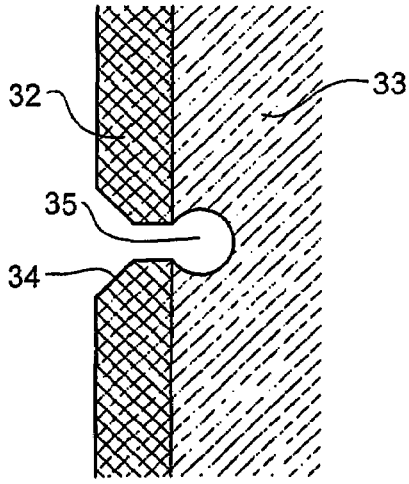
FIG. 5 is an enlarged view of part of the tapered stress joint of FIG. 4.

FIGS. 4 and 5 illustrate a third embodiment of the present invention which is a tapered stress joint 30, e.g. for a drilling or production riser in subsea petroleum production. The outer layer 31 of the joint 30 carries most of the longitudinal and bending loads in use. It is lined with a series of rings 32 which are bonded to the outer layer 31 by a tapered intermediate layer of plastics or polymer material, as in the first embodiment. The outer layer 31 may also be tapered instead. The outer layer 31 may be made of a high performance titanium or steel alloy which has excellent fatigue resistance but is vulnerable to mechanical surface damage and corrosive attack. The inner layer protects the outer from damage and is segmented to accommodate the accumulated underlying strains in the outer layer. The ring segments, being circumferentially continuous also contribute to the radial strength of the riser and help prevent collapse under hydrostatic pressure.

It will be appreciated that the above description is not intended to be limiting and that other modifications and variations fall within the scope of the present invention, which is defined by the appended claims.

The invention claimed is:

1. A method of reinforcing or reinstating an existing structure, comprising the steps of:

attaching a reinforcing metal layer to a metal panel in spaced apart relation to thereby form at least one cavity between surfaces of said metal panel and said reinforcing metal layer;

injecting an intermediate layer comprised of an uncured plastics or polymer material into said at least one cavity; and curing said plastics or polymer material so that it adheres to said surfaces of said metal panel and said reinforcing metal layer so as to transfer shear forces therebetween; wherein said existing metal structure comprises a generally tubular part and said reinforcing metal layer is attached inside tubular part; and wherein said reinforcing metal layer comprises a series of plates or shaped parts that are welded together in situ.

2. A method according to claim 1 wherein said existing structure is an off-shore structure.

3. A method according to claim 2, wherein said tubular part is a submerged or partly submerged part.

4. A method according to claim 1 wherein said tubular part is a submerged or partly submerged part.

5. A method according to claim 4, wherein said tubular part is a support leg or bracing member of an off-shore structure.

6. A method according to claim 1 wherein said tubular part is a support leg or bracing member of an off-shore structure.

7. A method according to claim 1 wherein said reinforcing metal layer comprises complete rings.

8. A method according to claim 1 wherein said reinforcing metal layer also covers end walls of the tubular part as well as side walls.

9. A method according to claim 1 wherein said reinforcing metal layer is made of steel, stainless steel or aluminium.

10. A method according to claim 1 wherein said reinforcing metal layer has a thickness in the range of 3 to 50 mm.

11. A method according to claim 1 wherein said plastics or polymer material comprises a compact elastomer.

12. A method of reinforcing or reinstating an existing structure, comprising the steps of:

attaching a reinforcing metal layer to said metal panel in spaced apart relation to thereby form at least one cavity between surfaces of said metal panel and said reinforcing metal layer;

injecting an intermediate layer comprised of an uncured plastics or polymer material into said at least one cavity; and curing said plastics or polymer material so that it adheres to said surfaces of said metal panel and said reinforcing metal layer so as to transfer shear forces therebetween; wherein said existing metal structure comprises a generally tubular part and said reinforcing metal layer is attached inside tubular part; and wherein said reinforcing layer comprises a series of plates that are welded together in situ.

13. A method according to claim 12 wherein said reinforcing layer also covers end walls of the tubular pad as well as side walls.

14. A method according to claim 12 wherein said reinforcing layer is made of steel, stainless steel or aluminium.

15. A method according to claim 12 wherein said reinforcing layer has a thickness in the range of 3 to 50 mm.

16. A method according to claim 12 wherein said plastics or polymer material comprises a compact elastomer.

17. A method according to claim 12 wherein said existing structure is an off-shore structure.

18. A method according to claim 12 wherein said tubular part is a submerged or partly submerged part.

19. A method according to claim 12 wherein said tubular part is a support leg or bracing member of an offshore structure.

* * * * *